US007181944B2

(12) United States Patent
Wuestefeld et al.

(10) Patent No.: US 7,181,944 B2
(45) Date of Patent: Feb. 27, 2007

(54) METHOD AND DEVICE FOR SHAPING STRUCTURAL PARTS BY SHOT BLASTING OR PEENING

(75) Inventors: Frank Wuestefeld, Herzogenrath (DE); Wolfgang Linnemann, Wuerselen (DE); Stefan Kittel, Aachen (DE)

(73) Assignee: Kugelstrahlzentrum Aachen GmbH, Aachen (DE)

( * ) Notice: Subject to any disclaimer, the term of this patent is extended or adjusted under 35 U.S.C. 154(b) by 766 days.

(21) Appl. No.: 10/333,943

(22) PCT Filed: Jul. 17, 2001

(86) PCT No.: PCT/DE01/02601

§ 371 (c)(1),
(2), (4) Date: Jan. 23, 2003

(87) PCT Pub. No.: WO02/10332

PCT Pub. Date: Feb. 7, 2002

(65) Prior Publication Data

US 2004/0025555 A1 Feb. 12, 2004

(30) Foreign Application Priority Data

Jul. 27, 2000 (DE) ..... 100 37 029

(51) Int. Cl.
*B21J 5/00* (2006.01)
*C21D 7/06* (2006.01)

(52) U.S. Cl. ..... 72/53; 29/90.7; 451/38
(58) Field of Classification Search ..... 72/53; 29/90.3; 451/38, 39

See application file for complete search history.

(56) References Cited

U.S. PATENT DOCUMENTS

| | | | | |
|---|---|---|---|---|
| 2,701,408 | A * | 2/1955 | Borger | 72/53 |
| 3,668,912 | A * | 6/1972 | Baughman et al. | 72/53 |
| 4,329,862 | A | 5/1982 | Harburn et al. | |
| 4,350,035 | A | 9/1982 | Kopp et al. | |
| 4,694,672 | A * | 9/1987 | Baughman | 72/53 |
| 4,974,434 | A * | 12/1990 | Reccius et al. | 72/53 |
| 5,596,912 | A * | 1/1997 | Laurence et al. | 72/53 |
| 5,771,729 | A | 6/1998 | Bailey et al. | |
| 6,584,820 | B1 * | 7/2003 | Benedict et al. | 72/53 |
| 6,938,448 | B2 * | 9/2005 | Kennerknecht et al. | 72/53 |

FOREIGN PATENT DOCUMENTS

| | | |
|---|---|---|
| DE | 2909303 | 9/1980 |
| JP | 52-099961 | 9/1977 |
| JP | 56/146672 | 11/1981 |

* cited by examiner

*Primary Examiner*—David B. Jones
(74) *Attorney, Agent, or Firm*—W. F. Fasse; W. G. Fasse

(57) ABSTRACT

A structural part includes a plate-shaped base body and ribs that extend longitudinally approximately parallel to one another, and that are joined integrally to and protrude orthogonally from the base body. In a shaping method, the structural part is shaped by particles of blasting or peening shot, which strike the surface areas of the structural part at a high velocity to cause a plastic deformation thereof. Opposite surface areas of the ribs, located on opposite longitudinal sides of each rib, are simultaneously subjected to the action of particles of the blasting shot. An apparatus to perform the method includes two nozzles arranged facing toward one another with the rib therebetween, to form two jets of the blasting shot particles directed toward one another at the rib.

11 Claims, 2 Drawing Sheets

METHOD AND DEVICE FOR SHAPING STRUCTURAL PARTS BY SHOT BLASTING OR PEENING

FIELD OF THE INVENTION

The invention relates to a method for shaping structural parts, especially such parts for use in aviation and space travel. The structural parts each include a plate-shaped base body and ribs which are longitudinally extended, are approximately parallel to one another, are joined integrally to the base body, and protrude orthogonally from the base body, with the shaping occurring by means of particles of blasting shot which strike the surface areas of the structural part at a high velocity and produce a plastic material shaping.

BACKGROUND INFORMATION

Especially in aeronautical and aerospace engineering so-called structural parts or integral parts are used which comprise ribs extending parallel with respect to each other (mostly on one side, but in certain circumstances also on both sides), while the side that is not provided with ribs is plane. If ribs are present both in the longitudinal direction as well as the transversal direction of the component which extend approximately perpendicular with respect to one another, the component is provided with a cassette structure. In order to curve such components it is necessary to apply complex processes because the ribs, especially when they extend parallel to the direction of curvature, offer considerable resistance against shaping.

Shaping methods of the kind mentioned above have long been used in aeronautical and aerospace engineering for curving large-surface components such as airfoils or fuselage shells. Blasting shot with a particle diameter of up to 2 to 4 mm is used in the shaping of structural parts. Whereas the blasting shot is applied with the help of spinner gates for the large-surface machining of components, hand blasting units are used for locally limited shaping. Said hand blasting units are also used for curving ribs. In order to enable the purposeful shaping of ribs that are usually flat on the basis of the blasting geometry and blasting diameter, the ribs are partly covered with a mask so that the desired elongation gradient is achieved in the rib zones to be shaped. Rubber or another impact-absorbent material is used for covering the surface sections of the ribs that are not to be blasted. The coverage of the ribs is cumbersome, especially when several masks need to be produced.

As an alternative to the aforementioned shot blasting method, the so-called clamping method (Eckhold method) is known from the state of the art. In this method clamps grasp the rib with a kind of grasp with two spaced clamping jaws at two adjacent places. As a result of a short movement of the two clamping jaws away from each other or towards each other the rib is either locally extended or swaged. As a result of a repeated application along the longitudinal extension of the rib it is possible to produce convex or concave curvatures. The curvature can be influenced by the stroke of the clamp and the number of repetitions of said applications.

Even if such clamping methods can be automated, it is still disadvantageous due to the low extensions per stroke of the clamping jaws which result in a lengthy shaping process. Despite the principally possible automation, the performing of the clamping method requires much experience by the operator, especially due to the danger of buckling and the spring-back behavior of the ribs.

Generally known are further so-called age creep forming methods for structural parts. The component is produced in a plane shape in this case by metal cutting, especially milling. Then the component is placed in a mold which has the external shape of the finished part. This shaping process usually takes several hours. A further disadvantage is that special molds need to be produced for each geometry. It is further necessary to determine the parameters, temperature, pressure and time for each part separately. Furthermore, the application of the age creep forming method is excluded for materials which are not suitable for the thermal treatment conducted thereby. A further difficulty is overextending the part in the mold by a certain amount in order to compensate the spring-back after the removal of the component from the mold in order to ensure the precise desired geometry of the part.

The state of the art also includes the shot peen forming method as known from the U.S. Pat. No. 4,329,862 for shot peen forming of plate-like parts, especially airfoil structures. It is not provided in this connection that the airfoil parts to be processed with the blasting shot are reinforced by ribs. The said US patent specification merely teaches that the part is stretched in a first step by blasting with blasting shot on either side and to curve it into another direction by blasting it with blasting shot on merely one side.

Finally, a method applied in practice for shaping structural parts consists of milling the same from solid material with the help of modern CNC milling machines. Apart from the considerable material input, this is merely possible for structures that are curved to an only very low extent. The costs incurred for raw material to be provided with a large thickness are considerable. That is why this method can be used in an economically viable manner only in a very few limited cases, especially where large-surface components are concerned. Moreover, there are strong back-spring effects in the finished part that are the result of the metal cutting process and impair its dimensional stability.

SUMMARY OF THE INVENTION

The object of the invention is to provide a method for shaping structural parts with which a large number of geometries can be realized in a reliable and cost-effective manner in the finished parts.

Based on the shaping methods of the kind mentioned above, this object is achieved in accordance with the invention in such a way that opposite surface areas of the ribs, with said surface areas being located on opposite longitudinal sides of each rib, are simultaneously subjected to the action of particles of the blasting shot.

Since the processed surface regions are situated directly opposite each other, any warping or distortion of the rib in the direction transversally to its longitudinal direction is securely prevented. Such a warping is likely in cases when the rib (as in the hand blasting method according to the state of the art) is charged merely on one side with blasting shot. The effectiveness of every single particle hit is increased on the other hand by blasting shot that impinges simultaneously from both sides onto the rib surface. The energy losses by elastic material deformations are minimized in the method in accordance with the invention. Depending on the height of the rib (relating to the base body) at which the application with blasting shot on either side occurs according to the method in accordance with the invention, it is thus possible to achieve both convex as well as concave curvatures of the structural part thus treated. The size of the radius of curvature is influenced by the size and speed of the particles of the blasting shot as well as the duration of the blasting treatment. A particular advantage of the method in accordance with the invention is that the shaping of structural parts can occur exclusively by blasting the ribs, so that an additional treatment of the base body can be omitted. An automation of the proposed process is also possible, especially when the geometry of the treated structural part is measured on-line and is included in a process-control strategy for controlling the process.

According to a modification of the method in accordance with the invention, it is possible to blast with particles of the blasting shot either a longitudinal strip of the rib adjacent to the rib base or a longitudinal strip of the rib adjacent to the rib head. The width of the longitudinal strip can correspond at most to the height of the rib.

In the first case as mentioned above, the longitudinal and/or transversal ribs of the part are extended in the base region by blasting with blasting shot. This leads to a concave curvature of the part, with the term concave relating to the side of the plate-like base body comprising the ribs.

In the alternative cases a convex curvature of the part is achieved by an extension of the longitudinal and/or transversal ribs in the head zone, i.e. in the vicinity of its face side extending in the longitudinal direction.

If the method in accordance with the invention is applied in structural parts with a cassette structure, i.e. with crossing longitudinal and transversal ribs, it is possible to produce both singleaxis as well as multiaxis component curvatures and involutes. If the longitudinal ribs are extended in the base region and the transversal ribs are extended in the head region, a combination of concave and convex curvature of the component is obtained, thus leading to a saddle-like geometry. In parts which comprise merely longitudinal or transversal ribs, a saddlelike structure can be achieved in such a way that a curvature transversely to the longitudinal direction of the ribs is performed by a blasting shot treatment of the base body in the manner as known in accordance with the state of the art (on one side).

In a further development of the invention it is proposed that the particles of the blasting shot have a mean diameter of more than 4 mm. In this way it is possible to reliably shape even structural parts with thick-walled ribs. Large-size particles, especially large-size balls with a diameter of more than 4 mm, allow a penetration of the ribs up to a large depth.

A further development of the method in accordance with the invention is that the particles of the blasting shot emerge from oppositely situated, mutually facing nozzles of a blasting apparatus which is moved in the longitudinal direction and the upward direction of the ribs. This allows an automation in performing the method and the realization of a large number of geometries.

It is further advantageous to move the nozzles synchronously in the same direction and with the same speed. This ensures that even in the case of a continuing displacement of the place of treatment mutually opposite surface areas of the rib are processed.

An apparatus for shaping structural parts, especially such for use in aviation and space travel, with the structural parts comprising a plate-shaped base body and ribs which are longitudinally extended, are approximately parallel to one another, are joined integrally to the base body, and protrude from the base body in orthogonal manner, allows blasting surface zones of the structural part with particles of blasting shot impinging at high speed, as a result of which a plastic material deformation is produced, and is characterized in accordance with the invention by at least two nozzles for a directed delivery of a particle jet each, with the two particle jets being directed towards each other and the nozzles having a larger distance from each other than the thickness of the rib. Preferably, the nozzles can be placed in intermediate spaces between adjacent ribs, making it possible to direct the particle jets under an angle of approx. 90° against the rib surface.

The shaping method as described above can be performed with such an apparatus with comparatively simple means. As a result of the fixed assignment of the two nozzles and the directions of delivery of the particle jets with respect to each other it is always ensured that mutually opposite surface areas of the ribs are processed. When the nozzles can be placed in intermediate spaces between adjacent ribs it is possible to provide a perpendicular direction of impingement of the particles on the surface areas to be processed.

Finally, it is provided for in accordance with the invention that the nozzles can be jointly moved in the longitudinal and upward direction of the ribs, making it possible to perform shapings even in large components at a large variety of places in the ribs. It is thus possible to realize a large number of possible geometrical shapings on the part to be shaped.

The method in accordance with the invention is now explained in closer detail by reference to an embodiment of an apparatus as shown in the drawing, wherein:

DETAILED DESCRIPTION OF EXAMPLE EMBODIMENTS OF THE INVENTION

Figure 1:
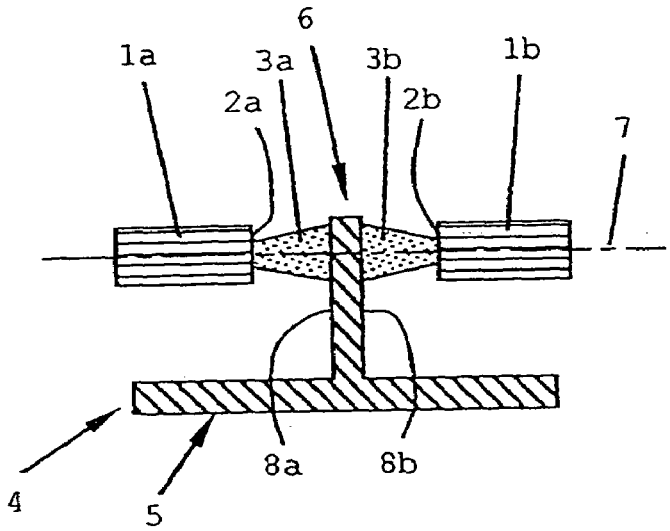
FIG. 1 shows an apparatus for shaping a structural part with two nozzles directed against each other.

FIG. 1 shows merely two nozzles 1*a* and 1*b* of an apparatus for shaping structural parts, with a slightly conical expanding jet 3*a*/3*b* of particle-like blasting shot emerging from the front side 2*a* and 2*b* of said nozzles. The particles of the blasting shot have a spherical shape and have a diameter of more than 4 mm (e.g. 6 mm). The supply of the blasting shot to the nozzles 1*a* and 1*b* as well as the further components of the blasting apparatus are generally known and therefore not shown in closer detail.

A structural part 4 is shaped from a metallic material by means of the shaping apparatus, which is only partly illustrated. The structural part 4 includes a plate-shaped base body 5, which is only shown in sections, and a plurality of ribs 6 which are connected integrally with the base body 5 and emerge therefrom in a right-angled manner. Only one of the ribs is shown in a sectional view for reasons of clarity of the illustration. The ribs 6 extend parallel and equidistant at such a distance from each other in such a processed part that the nozzles 1*a* and 1*b*, including the necessary feed device, can be positioned in the intermediate spaces between adjacent ribs 6. The distance between the nozzles 1*a* and 1*b* is dimensioned in such a way that the rib 6 which is to be treated can be interposed and the thickness of the rib still offers enough space between the nozzles 1*a*, 1*b* and the rib surface in order to ensure a trouble-free free-flight travel and discharge of the blasting shot as shown in FIG. 1.

FIG. 1 shows the case where the nozzles 1*a*/1*b* are aligned perpendicular to the rib 6. It is also possible to let the particle jet hit the rib surface in an inclined manner from above under an angle departing from 90°. The nozzles 1*a*/1*b* can then be arranged in a plane above the rib surface and can be moved.

The common longitudinal axis 7 of both nozzles 1*a*/1*b* extends perpendicular to the two side surfaces 8*a* and 8*b* of the rib 6. This ensures that mutually opposite and substantially congruent surface areas are blasted by the jets 3*a* and 3*b* on the mutually opposite side surfaces 8*a* and 8*b*. In the case of equal intensity of the blasting shot, a balance of power thus prevails in the zone of the blasted rib sections which prevents any buckling or one-sided deflection of the rib 6.

Figure 2A:
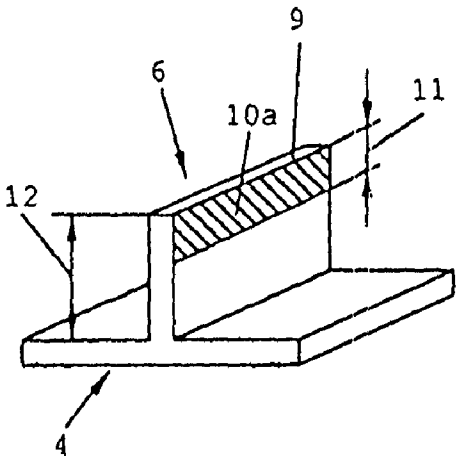
FIG. 2*a* shows a perspective view of a section of a structural part.
Figure 2B:
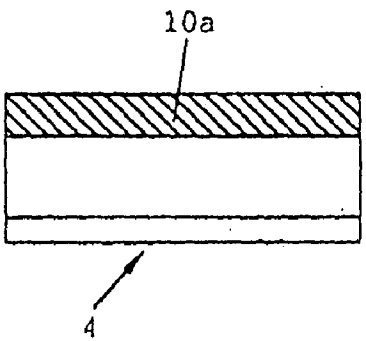
FIG. 2*b* shows a side view of the structural part according to FIG. 2*a;*

FIGS. 2*a* and 2*b* show a portion of a structural part 4 in a perspective view and a side view. In the structural part 4, a longitudinal strip 10 extends starting from a rib head 9 parallel to the longitudinal extension of rib 6 and is emphasized here. The longitudinal strip 10, whose width 11 is approx. 40% of the height 12 of the rib 6, is blasted with blasting shot with the help of nozzle 2*b*. Accordingly, an opposite longitudinal strip (which is not shown in the figure) with the same width 11 is also blasted with blasting shot, namely by using nozzle 2*a*. The nozzle arrangement as shown in FIG. 1 can therefore be moved in its entirety in the longitudinal direction of the rib 6 (e.g. with constant speed), i.e. without the two nozzles 2*a*/2*b* changing their position and alignment relative to each other.

Figure 2C:
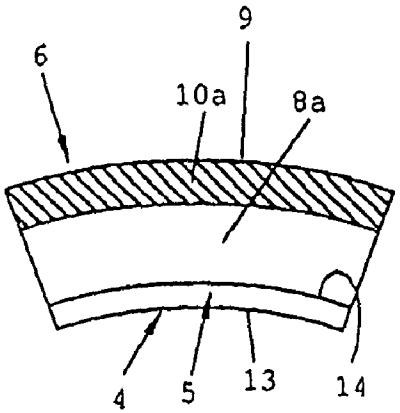
FIG. 2*c* shows a view as in FIG. 2*b*, but after producing a convex curvature.

FIG. 2*c* shows which form the structural part 4 assumes after a blasting shot treatment in the zone of the longitudinal strips 10*a* and 10*b*. As a result of the material extension occurring in the zone of rib head 9, i.e. an elongation of the part in this zone, both the rib 6 as well as the integrally connected base body 5 assume a convex curved shape. Despite the curved shape, the side surfaces 8*a* and 8*b* of the rib 6 are each situated within one plane.

In addition to the curvature in the longitudinal direction of the rib 6, the structural part 4 can be provided in addition with a curvature perpendicular to the longitudinal extension of the ribs 6 by a blasting shot treatment of either the lower side 13 or the upper side 14 of the base body 5. In this way it is possible to produce saddle-like structures.

In the case of structural parts with cassette structure, i.e. crossing ribs in the longitudinal and transversal direction of the component, such a saddle-like structure can be produced merely by a blasting shot treatment of the ribs. Optionally, an additional blasting shot treatment of the base body is possible.

Figure 3A:
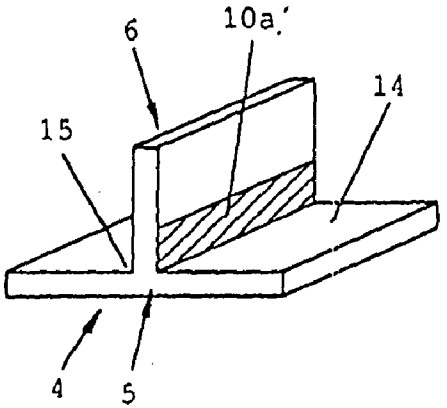
FIGS. 3*a* to 3*c* show views as in FIGS. 2*a* to 2*c*, but for producing a concave curvature.
Figure 3B:
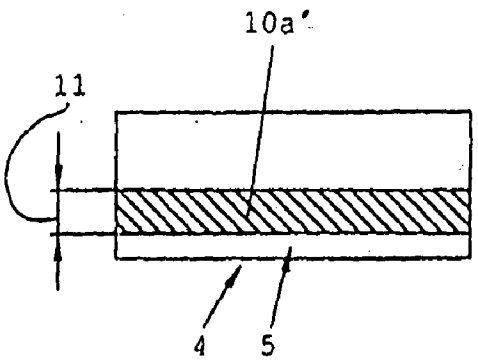
Figure 3C:
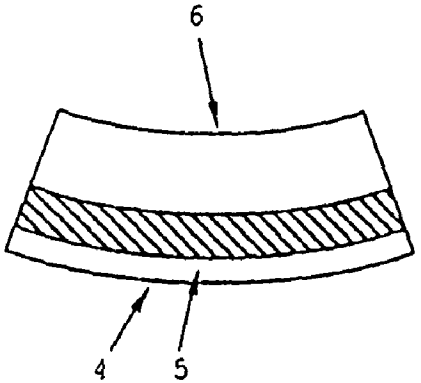

FIGS. 3*a* to 3*c* show the case that with the help of a blasting shot treatment a concave curvature of the structural part 4 is to be produced. The longitudinal strip 10*a*' is situated in this case in the zone of the rib base 15 and is directly adjacent to the upper side 14 of the base body 5.

After performance of the blasting shot treatment of the mutually opposite longitudinal strips, the structural part 4 assumes the concave curved shape as shown in FIG. 3*c*. As a result of the extension of the rib 6 in its base region, the material of the plate-shaped base body 5 is also extended. The width 11 of the mutually opposite longitudinal strips (10*a*' and its mutually opposite partner) is again approx 40% of the height of the structural part 4.

Figure 4:
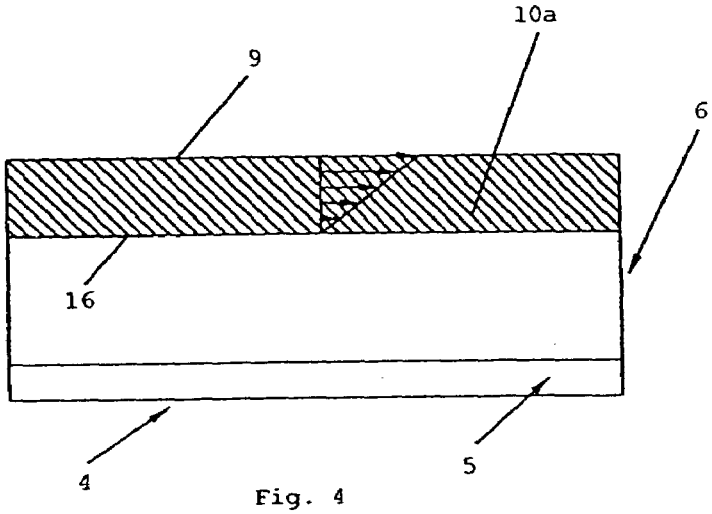
FIG. 4 shows the elongation distribution in a rib with a convex curvature.
Figure 5:
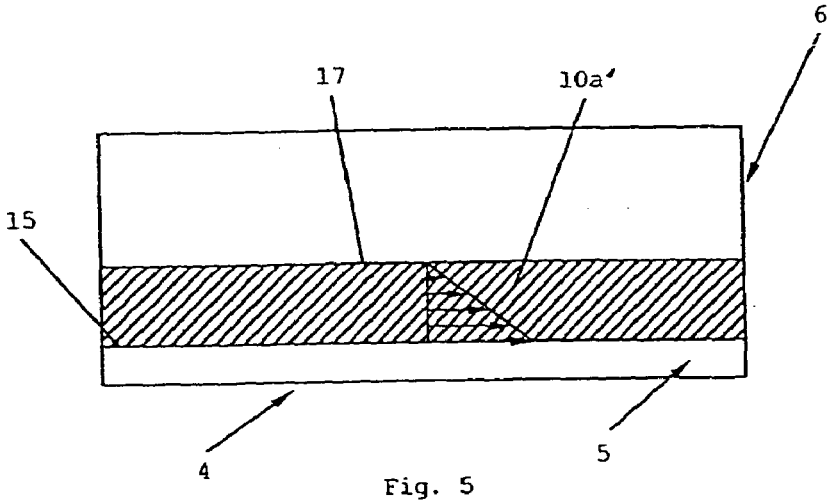
FIG. 5 shows a view as in FIG. 4, but with a concave curvature.

FIGS. 4 and 5 finally show the extension distribution in the zone of the longitudinal strips 10a (at the rib head) and 10*a*' (at the rib base) which are to be treated with blasting shot. Whereas the elongation in the case as shown in FIG. 4 increases linearly from zero to a maximum value starting from a lower limiting line 16 of the edge strip 10*a* up to the rib head 9, the elongation in the structural part 4 according to FIG. 5 grows linearly starting from an upper limiting line 17 of the longitudinal strip 10*a*' down to the rib base 15 at the transition point into the base body 5 where there is a maximum value of the elongation.

The invention claimed is:

1. A method for shaping a structural part including a plate-shaped base body and ribs which are longitudinally extended, are approximately parallel to one another, are joined integrally to the base body, and protrude from the base body in an orthogonal manner, said method comprising forming and directing two jets of free-flying particles of blasting shot so as to respectively strike two opposite surface areas of one of the ribs and produce a plastic material shaping, wherein the opposite surface areas of the rib are located on opposite longitudinal sides of the rib, and the two jets are directed simultaneously at the two opposite surface areas.

2. The method as claimed in claim 1, wherein a respective one of the two opposite surface areas comprises a longitudinal strip adjacent to a rib base of the rib, wherein the longitudinal strip has a width corresponding at most to half of a height of the rib.

3. The method as claimed in claim 1, wherein a respective one of the two opposite surface areas comprises a longitudinal strip adjacent to a rib head of the rib, wherein the longitudinal strip has a width corresponding at most to half of a height of the rib.

4. The method as claimed in claim 3, wherein the particles of the blasting shot have an average diameter of more than 4 mm.

5. The method as claimed in claim 1, comprising discharging the two jets of the free-flying particles of the blasting shot from oppositely situated, mutually facing nozzles of a blasting apparatus, and moving the nozzles in a longitudinal and upward direction of the ribs.

6. The method as claimed in claim 5, comprising moving the nozzles synchronously in the same direction with the same speed as one another.

7. An apparatus for shaping a structural part that includes a plate-shaped base body (5) and ribs (6) which are longitudinally extended, are approximately parallel to one another, are joined integrally to the base body (5), and protrude from the base body (5) in an orthogonal manner, wherein the apparatus is adapted for conveying particles of blasting shot onto surface zones of he structural part (4) where the particles produce a plastic material deformation, wherein the apparatus comprises at least two nozzles (1*a*/1*b*) that are respectively adapted to convey and produce a directed delivery of two particle jets (3*a*, 3*b*) of the free-flying particles of blasting shot, wherein the two particle jets (3*a*, 3*b*) are directed toward each other, and wherein the nozzles (1*a*, 1*b*) are arranged facing toward each other at a spacing distance from each other that is larger than a thickness of the rib (6).

8. The apparatus as claimed in claim 7, wherein the nozzles (1*a*, 1*b*) are dimensioned and arranged so as to be placed in intermediate spaces between adjacent ones of the ribs (6).

9. The apparatus as claimed in claim 7, wherein the nozzles (1*a*, 1*b*) are arranged so as to be movable jointly in a longitudinal direction and upward direction of the ribs (6).

10. A method of shaping a structural part that includes a plate-shaped base body and a rib joined integrally to, extending longitudinally along, and protruding outwardly from said base body, wherein said method comprises the steps:

a) conveying first blasting shot particles from a first nozzle to form a first free-flying particle jet of said first blasting shot particles;

b) conveying second blasting shot particles from a second nozzle to form a second free-flying particle jet of said second blasting shot particles;

c) directing said first free-flying particle jet at a first surface area of said rib so that said first blasting shot particles strike against and cause a plastic deformation of said rib at said first surface area;

d) simultaneously with said step c), directing said second free-flying particle jet at a second surface area of said rib so that said second blasting shot particles strike against and cause a plastic deformation of said rib at said second surface area;

wherein said first and second surface areas are mutually opposite first and second surface areas respectively located opposite one another on opposite longitudinal sides of said rib.

11. The method according to claim 10, wherein said first and second surface areas are respective longitudinal strip areas extending longitudinally along said opposite longitudinal sides of said rib adjacent to a rib base of said rib adjoining said base body or adjacent to a rib head of said rib opposite said rib base, and wherein a width of each one of said longitudinal strip areas corresponds to at most one half of a width of said rib protruding outwardly from said base body.

* * * * *

UNITED STATES PATENT AND TRADEMARK OFFICE

CERTIFICATE OF CORRECTION

PATENT NO. : 7,181,944 B2
APPLICATION NO. : 10/333943
DATED : February 27, 2007
INVENTOR(S) : Wuestefeld et al.

It is certified that error appears in the above-identified patent and that said Letters Patent is hereby corrected as shown below:

Title page,
Item [56], References Cited, FOREIGN PATENT DOCUMENTS,
Line 2, after "52-099961", replace "9/1977" by --8/1977--;
Following line 3, insert --OTHER PUBLICATIONS
"Kugelstrahl-Umformen und -Richten", R. Kopp et al., METALL, Vol. 34, No. 4, April 1980 (1980-04), pages 320-323, XP002182934, Heidelberg, Fed. Rep. of Germany--;

Column 4,
Following line 22, insert --BRIEF DESCRIPTION OF THE DRAWINGS--;
Line 27, delete "BRIEF DESCRIPTION OF THE DRAWINGS";

Column 5,
Line 66, after "again", replace "approx" by --approx.--;

Column 6,
Line 54, after "zones of", replace "he" by --the--.

Signed and Sealed this

Tenth Day of July, 2007

JON W. DUDAS
*Director of the United States Patent and Trademark Office*